US010988291B2

(12) United States Patent
Levy et al.

(10) Patent No.: US 10,988,291 B2
(45) Date of Patent: Apr. 27, 2021

(54) TRAVEL BOTTLE HAVING A TWISTING LOCKING RING BODY

(71) Applicant: Navajo Manufacturing Company, Inc., Denver, CO (US)

(72) Inventors: Gordon Levy, Golden, CO (US); Shawn A. Shelton, Highlands Ranch, CO (US)

(73) Assignee: Navajo Manufacturing Company, Inc., Denver, CO (US)

( * ) Notice: Subject to any disclaimer, the term of this patent is extended or adjusted under 35 U.S.C. 154(b) by 76 days.

(21) Appl. No.: 16/414,166

(22) Filed: May 16, 2019

(65) Prior Publication Data

US 2020/0361680 A1 Nov. 19, 2020

(51) Int. Cl.

| | |
|---|---|
| ***B65D 55/02*** | (2006.01) |
| ***B65D 47/12*** | (2006.01) |
| ***B65D 47/08*** | (2006.01) |

(52) U.S. Cl.

CPC ..... *B65D 55/02* (2013.01); *B65D 47/0838* (2013.01); *B65D 47/122* (2013.01); *B65D 2255/00* (2013.01)

(58) Field of Classification Search

CPC ..... B65D 55/02; B65D 47/0838; B65D 2255/00; B65D 47/30; B65D 47/47305; B65D 50/02; B65D 50/06; B65D 50/061; B65D 50/062; B65D 47/305

See application file for complete search history.

(56) References Cited

U.S. PATENT DOCUMENTS

| | | | | |
|---|---|---|---|---|
| 3,094,255 | A | 6/1963 | Hunter | |
| 3,358,890 | A | 12/1967 | Dalfo | |
| 3,460,719 | A | 8/1969 | O'Donnell et al. | |
| 3,484,023 | A | 12/1969 | Meshberg | |
| 3,655,099 | A | 4/1972 | Hazard | |
| 3,702,165 | A | 11/1972 | Carrow et al. | |
| 3,773,203 | A * | 11/1973 | Grimaldi | B65D 47/0838 215/223 |
| 3,784,060 | A | 1/1974 | Hazard | |
| 3,847,313 | A | 11/1974 | Micallef | |
| 3,848,778 | A | 11/1974 | Meshberg | |
| 3,873,005 | A | 3/1975 | Hazard | |
| 3,874,568 | A | 4/1975 | La Vange et al. | |
| 4,047,643 | A | 9/1977 | Hazard | |
| 4,081,113 | A | 3/1978 | Hazard | |
| 4,299,339 | A | 11/1981 | Giroux et al. | |
| 4,487,342 | A | 12/1984 | Shy | |
| 4,500,016 | A | 2/1985 | Funfstuck | |
| 4,542,837 | A | 9/1985 | Rayner | |
| 4,591,079 | A | 5/1986 | Bigotte | |
| 4,645,086 | A | 2/1987 | Rosenthal | |
| 4,776,501 | A | 10/1988 | Ostrowsky | |
| 4,779,773 | A | 10/1988 | Bennett | |
| 4,962,869 | A | 10/1990 | Gross et al. | |
| 5,141,129 | A | 8/1992 | Jennings | |
| 5,284,264 | A | 2/1994 | Gross | |

(Continued)

*Primary Examiner* — Andrew T Kirsch
(74) *Attorney, Agent, or Firm* — Studebaker & Brackett PC

(57) ABSTRACT

A bottle includes a secure sealing mechanism. A bottle cap screwed onto a bottle maintains the contents of the bottle. This is achieved by securing a dispensing mechanism in a closed, locked position and sealing an outlet so that any liquids being forced into a dispensing passageway are prevented from passing through the passageway.

10 Claims, 5 Drawing Sheets

(56) References Cited

U.S. PATENT DOCUMENTS

| | | | | |
|---|---|---|---|---|
| 5,314,093 | A | 5/1994 | Gross et al. | |
| 5,622,284 | A | 4/1997 | Sawicki | |
| 5,649,645 | A | 7/1997 | Demarest et al. | |
| 6,896,160 | B2 | 5/2005 | Kaufman et al. | |
| 6,971,547 | B2 | 12/2005 | Englert et al. | |
| 9,382,059 | B2 | 7/2016 | Selinger et al. | |
| 10,167,120 | B1 | 1/2019 | Levy et al. | |
| 2003/0038146 | A1 | 2/2003 | Meshberg | |
| 2004/0112927 | A1 | 6/2004 | Kaufman et al. | |
| 2009/0255897 | A1* | 10/2009 | Buczkowski ..... | B65D 51/245<br>215/230 |

* cited by examiner

TRAVEL BOTTLE HAVING A TWISTING LOCKING RING BODY

FIELD OF THE INVENTION

The present invention relates to the field of bottles which require a secure locking to prevent accidental dispensing of its contents.

BACKGROUND OF THE INVENTION

Oftentimes, when traveling, individuals carry miniaturized versions of full sized liquid content bottles. However, the problem encountered is that the small, travel size bottles often leak or accidentally dispense fluids due to contact with the bottle or pressurization of an airline compartment which forces liquids from the bottle. This causes a mess throughout all of the travel contents.

SUMMARY OF THE INVENTION

By the present invention, a bottle includes a secure sealing mechanism. A locking ring body engages with a pivotal bottle cap lid of a main cap body of a bottle to maintain the contents of the bottle. This is achieved by securing a dispensing mechanism in a closed, locked position and sealing an outlet so that any liquids being forced into a dispensing channel are held within the channel.

This is achieved by the use of a bottle cap lid that can be pivoted into an opened position and a closed position. When the bottle cap lid is in the closed position the bottle is "locked" by a twisting or rotating of the locking ring body to a locked position. The locked position is indicated by markings on the locking ring body.

When the locking ring body is rotated in an opposite direction, the bottle cap lid is freed to pivotally move away from the bottle. Liquid may then be dispensed from the bottle.

The bottle cap includes the bottle cap lid and a main cap body. The bottle cap lid is pivotally mounted on the main cap body. The pivotal connection between the main cap body and the bottle cap lid is a living hinge integrally formed with the main cap body and the bottle cap lid.

The bottle cap lid includes a projection that snap fits into an outlet channel when the bottle cap lid is moved into the closed position. The outlet channel extends through a flat plate of the main cap body.

The locking ring body is rotatably mounted on the main cap body. The locking ring body is rotatable through 55° from the unlocked position to the locked position and vice versa. In the unlocked position of the locking ring body, the bottle cap lid is liftable by pivoting away from the main cap body to dispense fluids through the outlet channel of the main cap body.

When the locking ring body is rotated to the closed or locked position, an extrusion of the locking ring body engages a grooved latch of the bottle cap lid to hold the bottle cap lid in a fixed position. The extrusion of the bottle cap lid is engaged in the outlet channel. The bottle cap lid may then not be moved, thereby securing the contents of the bottle within the bottle.

Accordingly, it is an object of the present invention to provide a travel bottle with a rotating locking ring body.

It is another object of the present invention to provide a travel bottle with a rotating locking ring body to secure a bottle cap lid of a main cap body in a closed, locked position or an open, dispensing position.

It is still yet another object of the present invention to provide a travel bottle with a twisting locking ring body to secure a bottle cap lid of a main cap body in a closed, locked position or an open, dispensing position by a rotation of the twisting locking ring body through 55° of rotation to move between the closed, locked position and the open, dispensing position, with the open dispensing position allowing pivotal movement of the bottle cap lid away from the main cap body.

It is still another object of the present invention to provide a travel bottle with the rotating locking ring body to secure a bottle cap lid of a main cap body in a closed, locked position or an open, dispensing position by a rotation of the locking ring body through 55° of rotation to move between the closed, locked position and the open, dispensing position, with the open dispensing position of the locking ring body allowing pivotal movement of the bottle cap lid away from the main cap body to open a dispensing channel of the main cap body for passage of the contents of the bottle therethrough and in the closed, locked position of the locking ring body preventing pivotal movement of the bottle cap lid away from the main cap body to thereby seal the liquid contents within the bottle.

These and other objects of the invention, as well as many of the intended advantages thereof, will become more readily apparent when reference is made to the following description taken in conjunction with the accompanying drawings.

BRIEF DESCRIPTION OF THE DRAWINGS

The following drawings illustrate examples of various components of the invention disclosed herein, and are for illustrative purposes only. Other embodiments that are substantially similar can use other components that have a different appearance.

DETAILED DESCRIPTION OF THE PREFERRED EMBODIMENTS

Figure 1:
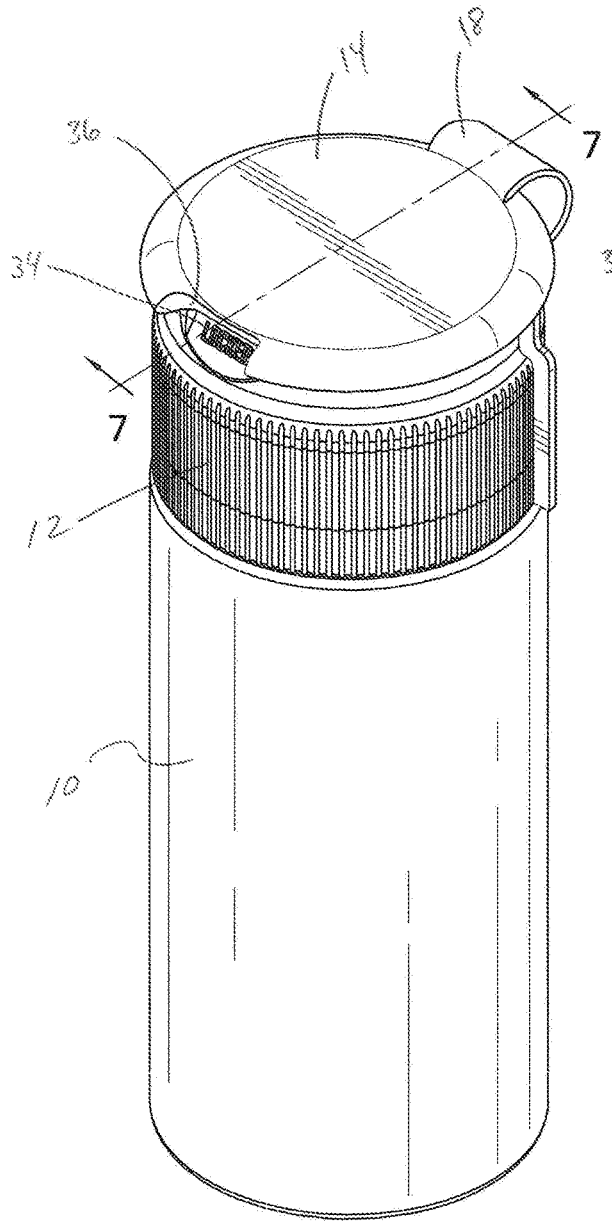
FIG. 1 illustrates a travel bottle having a locking ring body of the present invention mounted on the travel bottle in a locked position.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
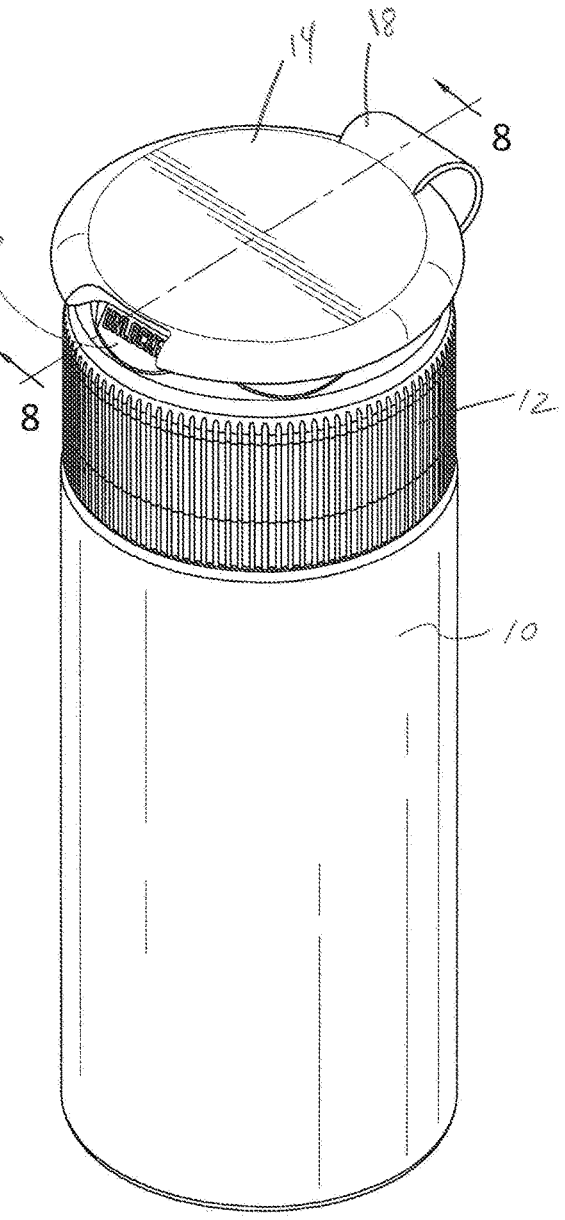
FIG. 2 illustrates the locking ring body of the present invention mounted on the travel bottle in an unlocked position.

As shown in FIGS. 1 through 4, a travel bottle 10 includes a locking ring body 12 shown in various positions amongst the four figures. FIG. 1 represents a closed, locked position of the locking ring body 12 and the bottle cap lid 14. FIG. 2 represents an unlocked position of the locking ring body 12 and the bottle cap lid 14.

Figure 3:
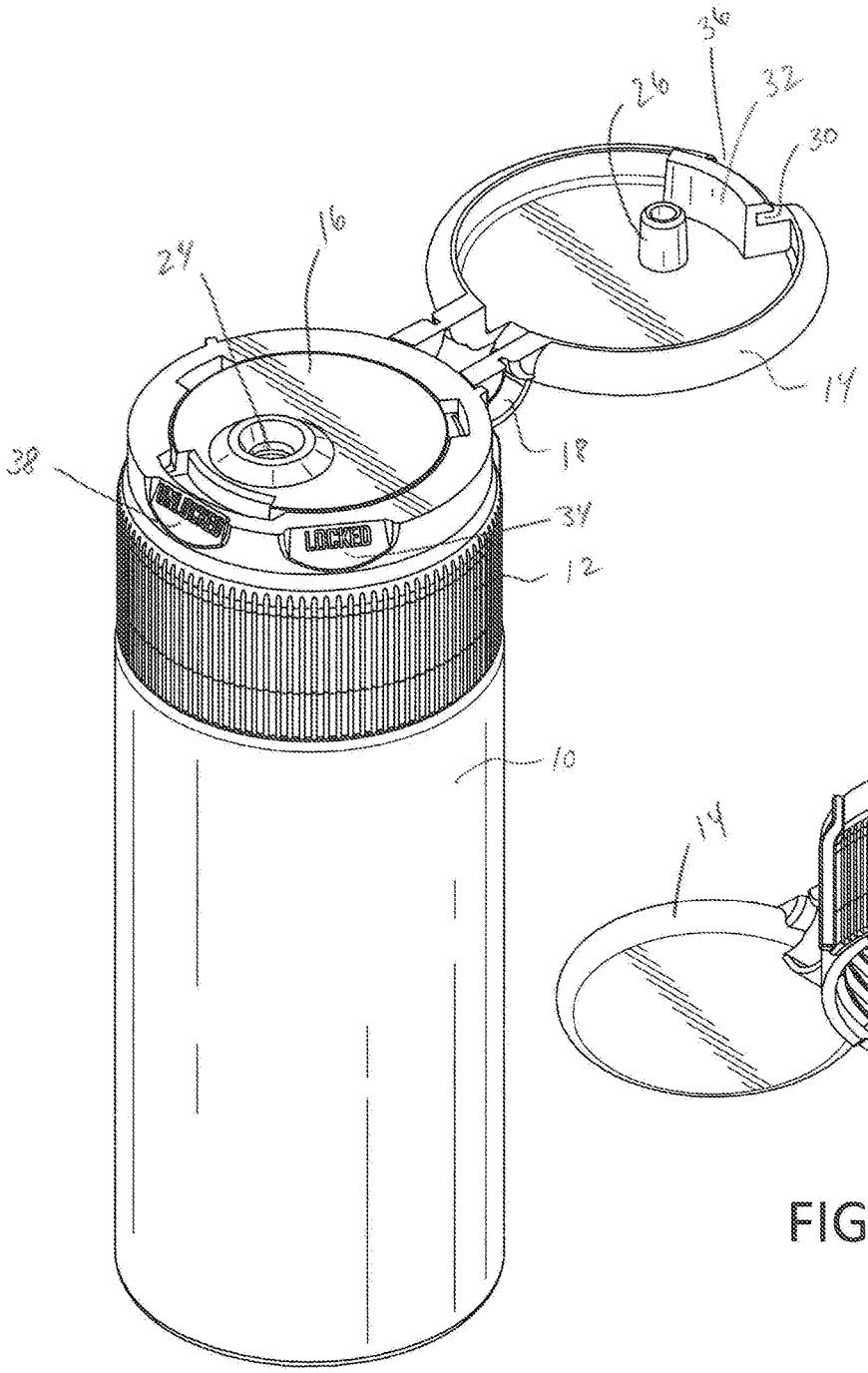
FIG. 3 illustrates a travel bottle cap with the locking ring body in an unlocked position and a pivotal bottle cap lid pivoted away from a main cap body into a dispensing position.
Figure 4:
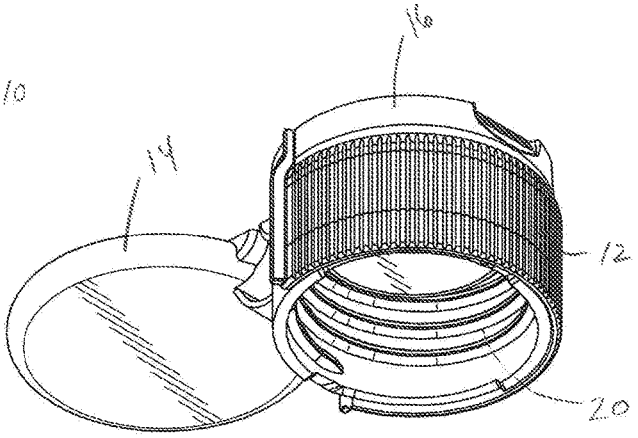
FIG. 4 is a bottom view of the travel bottle cap.

FIG. 3 represents an unlocked position of the locking ring body and the bottle cap lid with the bottle cap lid pivoted away from the main cap body 16 into a dispensing position. The bottle cap lid 14 is pivotally mounted on the main cap body 12 by a living hinge 18. FIG. 4 illustrates the internal threading 20 of the main cap body. The internal threading 20 engages with external threading 22 at the top of the travel bottle 10.

Figure 5:
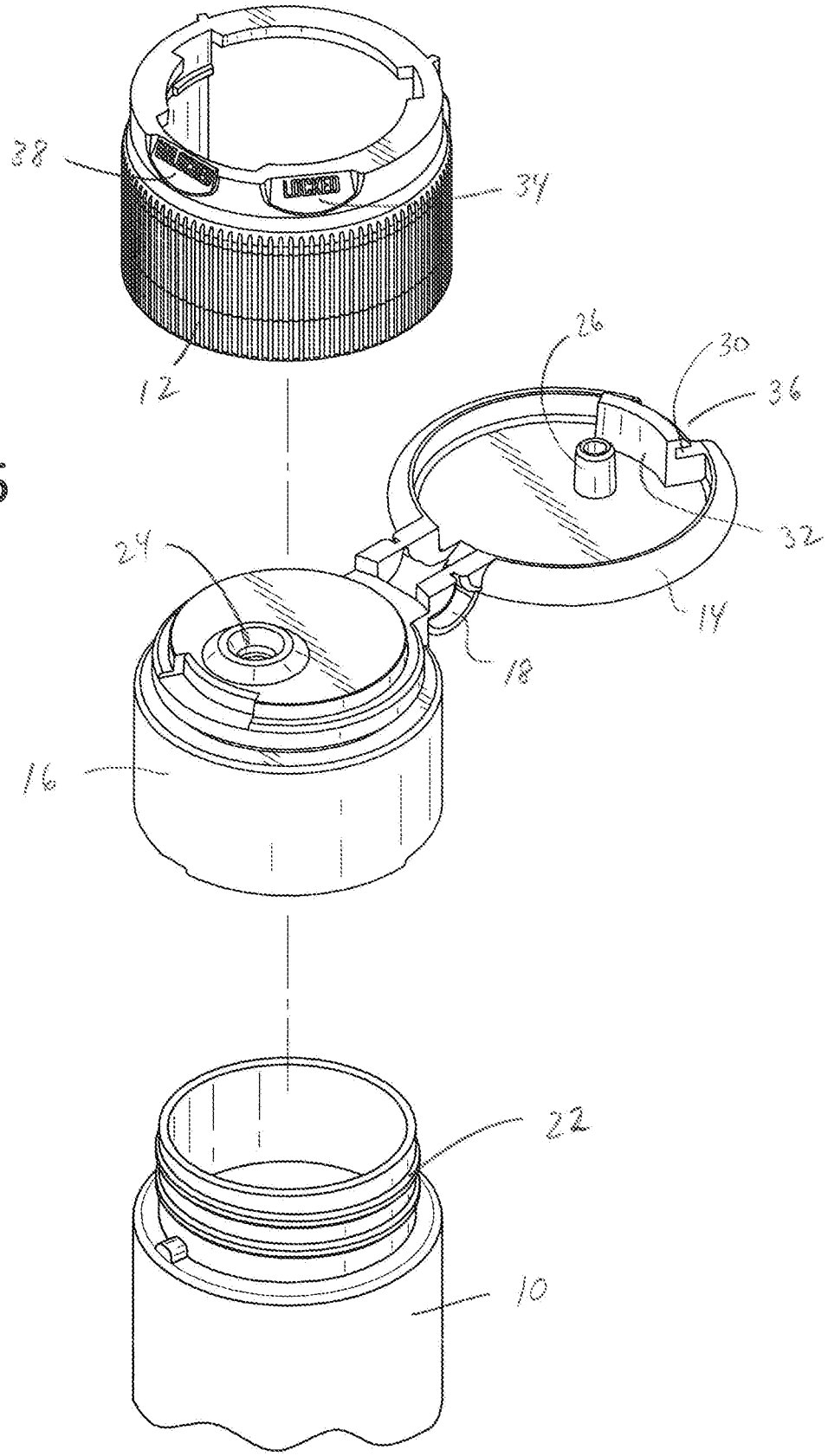
FIG. 5 is an exploded view of the travel bottle, locking ring body and main cap body with the pivotally mounted bottle cap lid.
Figure 6:
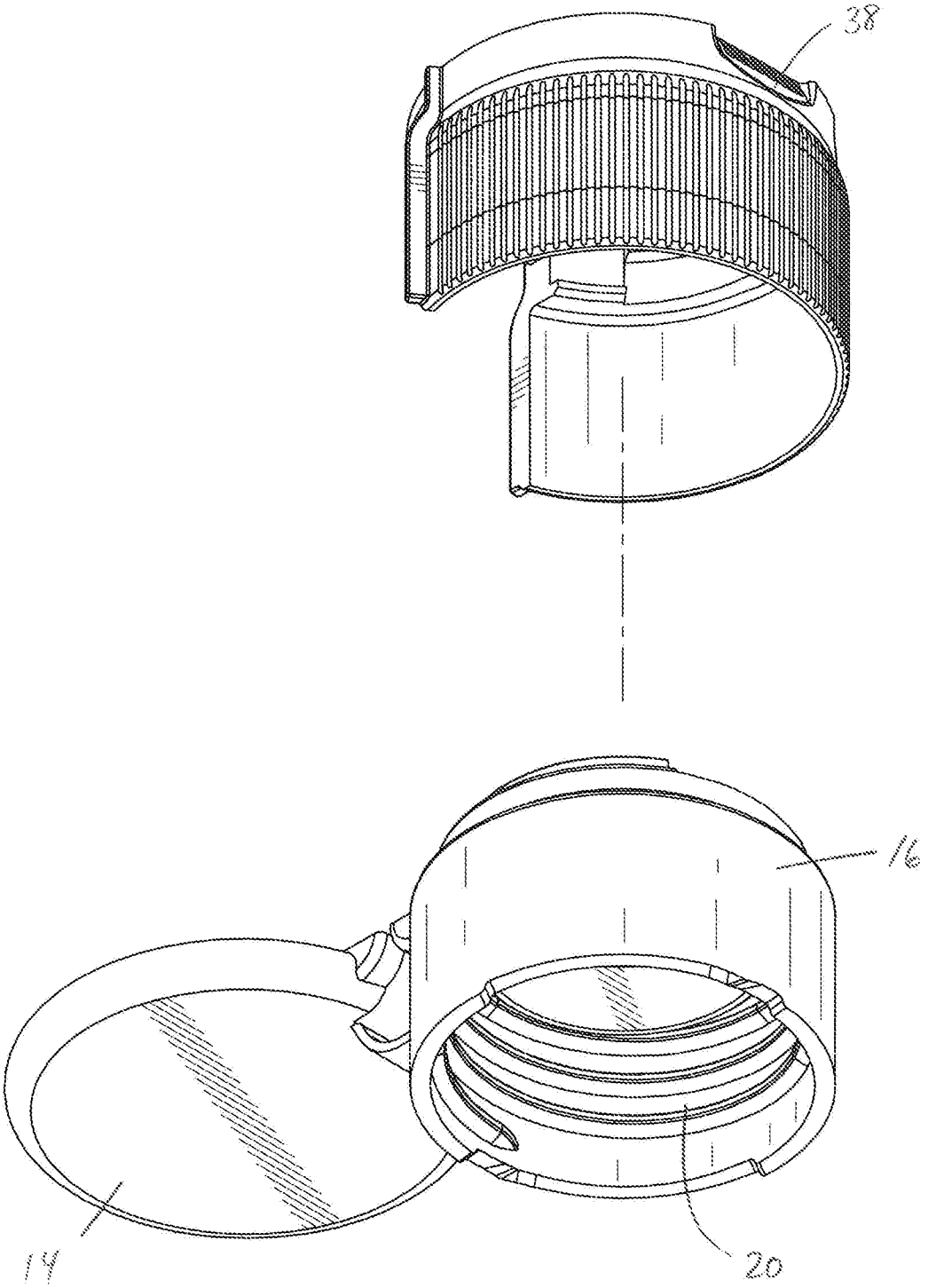
FIG. 6 is an exploded view of the locking ring body separated from the main cap body.

As shown in FIG. 5, the locking lid includes two components. The locking lid includes bottle cap lid 14 pivotally mounted on the main cap body 16 by living hinge 18. The main cap body includes a passageway 24 through which fluid may flow from the bottle 10. A projection 26 extending from an underside of bottle cap lid 14 is aligned with passageway 24 when the bottle cap lid is closed. The projection 26 seals the passageway 24 to prevent escape of fluids from the interior of bottle 10 when the bottle cap lid is the closed position.

The locking ring body 12 is rotatably mounted on main cap body 16. Locking ring body 12 is rotatable through an angle of approximately 55° to hold bottle cap lid 14 in the closed position so as to block outlet passageway 24 with projection 26 of the bottle cap lid 14 in a locked position and to allow opening of outlet passageway 24 by the pivoting away of bottle cap lid 14 in an open position of locking ring body 12.

The locking ring body includes a radially inwardly extending projection 28 along a part of its interior surface which slides into a groove 30 of a hooked projection 32 located on an underside of bottle cap lid 14. The engagement of projection 28 in groove 30, as shown in FIG. 7 only occurs when the locking ring body is rotated into the locked position of the locking ring body as shown in FIG. 1.

Figure 7:
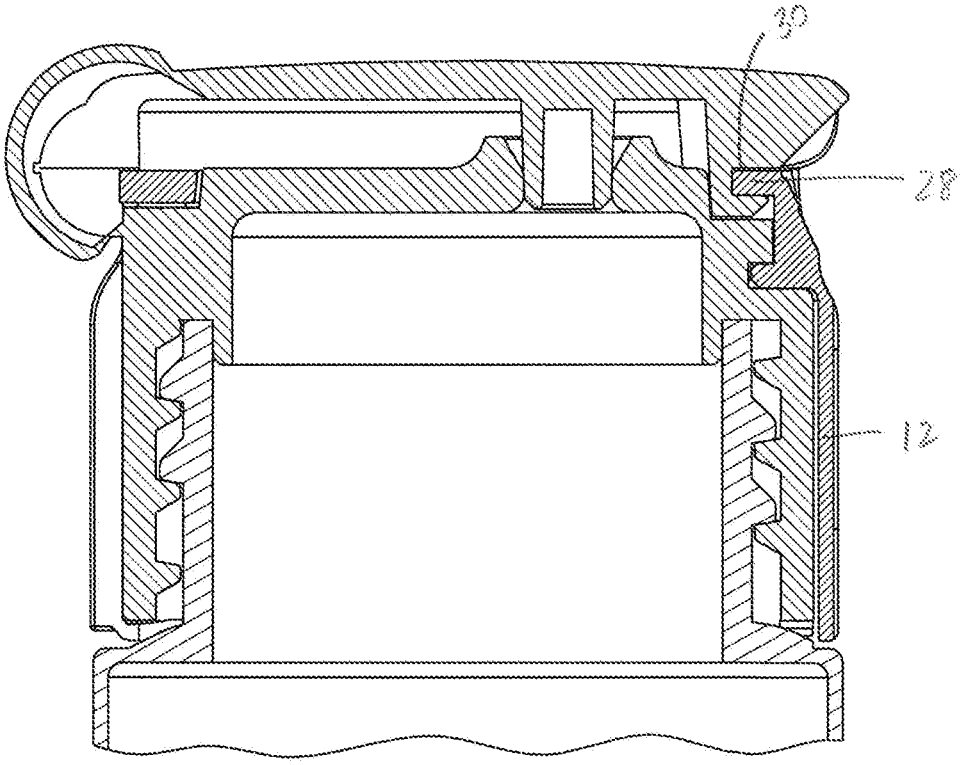
FIG. 7 is a sectional view taken along line 7-7 as shown in FIG. 1.
Figure 8:
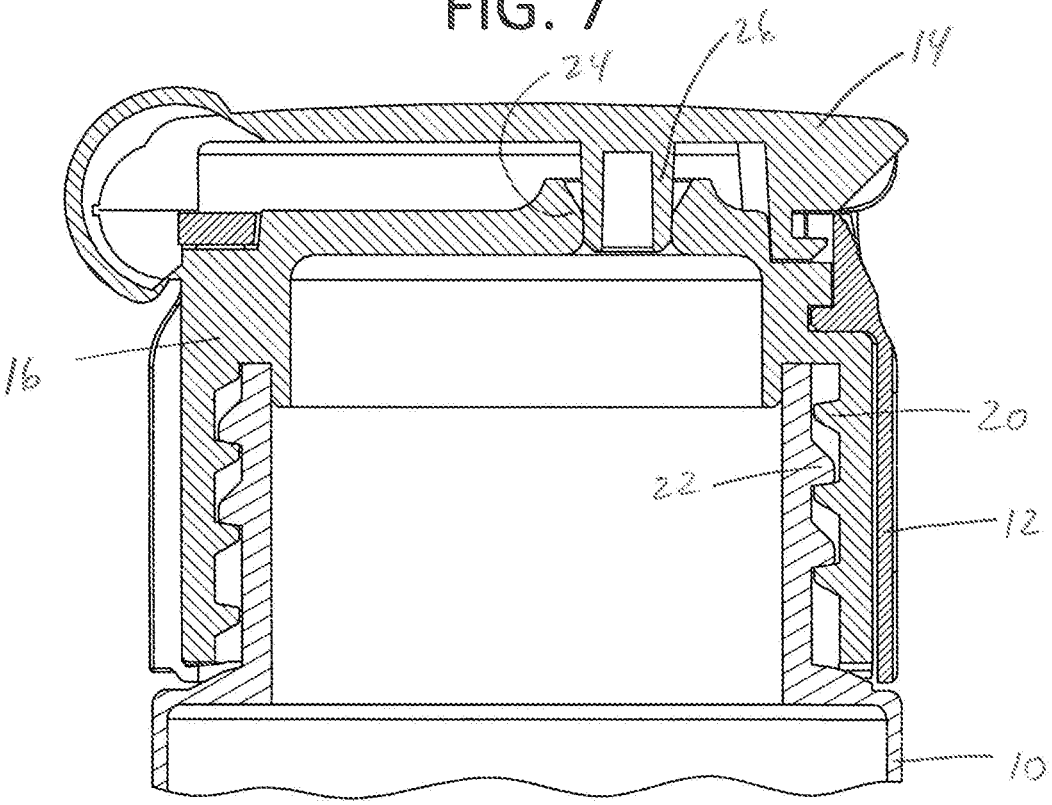
FIG. 8 is a sectional view taken along line 8-8 as shown in FIG. 2.

As shown in FIGS. 1 and 7, when the locking ring body is rotated to the fully locked position, a marker 34 exhibits a "LOCKED" icon extending through a cutout portion 36 on the bottle cap lid 14. However, when the locking ring body 12 is rotated to the position shown in FIGS. 2, 3 and 8, the marker 38 exhibits an "UNLOCKED" icon to visually demonstrate that the locking ring body 12 is in an open position. At this point, as shown in FIG. 3, the bottle lid cap 14 may be elevated so as to remove the projection 26 from the passageway 24 to thereby remove the contents from bottle 10 upon inversion of bottle 10 and squeezing of bottle 10.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A cap of a dispensing bottle, said cap comprising a main cap body, a bottle cap lid, said bottle cap lid being mounted by a hinge on a peripheral edge of said main cap body, said bottle cap lid being removably mounted on the main cap body and pivotably mounted on the peripheral edge of the main cap body, a locking ring body rotatably mounted on the main cap body, said locking ring body mounting said bottle cap lid in a fixed position on said main cap body in a locked position of said locking ring body and said locking ring body allowing said bottle cap lid to be pivoted on the peripheral edge of the main cap body and moved away from said main cap body in an unlocked position of said locking ring body, said locking ring body including a radially inwardly extending projection, the radially inwardly extending projection preventing pivoting of said bottle cap lid on said peripheral edge of said main cap body, away from said main cap body, when said locking ring body is in said locked position, and a groove in said bottle cap lid opening in a radially outward direction, said groove cooperating with the radially inwardly extending projection in said locking ring body by location of said radially inwardly extending projection in between an upper surface and a lower surface of said groove to lock the locking ring body with the bottle cap lid when said locking ring body is manually rotated into said locked position of said locking ring body and said radially inwardly extending projection being disengaged from said groove when said locking ring body is manually rotated into said unlocked position of said locking ring body to allow pivoting of said bottle cap lid on said peripheral edge of said main cap body, said main cap body including a passageway for liquid from the dispensing bottle, said passageway being blocked by said bottle cap lid in said locked position of said bottle cap lid and said locking ring body, said bottle cap lid including a projection extending into and snap fitting into said passageway, thereby blocking said passageway of said main cap body in said locked position of said locking ring body, said projection on said bottle cap lid being moved away from said passageway of said main cap body when said locking ring body is in said unlocked position and said bottle cap lid is pivoted on said peripheral edge of said main cap body.

2. The cap of a dispensing bottle according to claim 1, wherein said locking ring body includes a locked icon and an unlocked icon.

3. The cap of a dispensing bottle according to claim 1, wherein said locking ring body is rotatable 55° on said main cap body.

4. The cap of a dispensing bottle according to claim 2, wherein said bottle cap lid includes a cutout portion for viewing the locked icon in the locked position of said locking ring body on said main cap body and the unlocked position of said locking ring body on said main cap body.

5. The cap of a dispensing bottle according to claim 1, wherein said locking ring body has a plurality of ridges surrounding an outer surface.

6. A cap of a dispensing bottle, said cap comprising a main cap body, a bottle cap lid, said bottle cap lid being mounted by a hinge on a peripheral edge of said main cap body, said bottle cap lid being removably mounted on the main cap body and pivotably mounted on the peripheral edge of the main cap body, a locking ring body rotatably mounted on the main cap body, said locking ring body mounting said bottle cap lid in a fixed position on said main cap body in a locked position of said locking ring body and said locking ring body allowing said bottle cap lid to be pivoted on the peripheral edge of the main cap body and moved away from said main body in an unlocked position of said locking main body, said locking ring body including a radially inwardly projected projecting ledge, said radially inwardly projecting ledge extending only partially around an inner circumference of said locking ring body, said locking ring body including a radially inwardly extending projection, the radially inwardly extending projection preventing pivoting of said bottle cap lid on said peripheral edge of said main cap body, away from said main cap body, when said locking ring body is in said locked position, and a groove in said bottle cap lid opening in a radially outward direction, said groove cooperating with the radially inwardly extending projection in said locking ring body by location of said radially inwardly extending projection in between an upper surface and a lower surface of said groove to lock the locking ring body with the bottle cap lid when said locking ring body is manually rotated into said locked position of said locking ring body and said radially inwardly extending projection being disengaged from said groove when said locking ring body is manually rotated into said unlocked position of said locking ring body to allow pivoting of said bottle cap lid on said peripheral edge of said main cap body, said main cap body including a passageway for liquid from the dispensing bottle, said passageway being blocked by said bottle cap lid in said locked position of said bottle cap lid and said locking ring body, said bottle cap lid including a projection extending into and snap fitting into said passageway, thereby blocking said passageway of said main cap body in said locked position of said locking ring body, said projection on said bottle cap lid being moved away from said passageway of said main cap body when said locking ring body is in said unlocked position and said bottle cap lid is pivoted on said peripheral edge of said main cap body.

7. The cap of a dispensing bottle according to claim 6, wherein said locking ring body includes a locked icon and an unlocked icon.

8. The cap of a dispensing bottle according to claim 6, wherein said locking ring is rotatable 55° on said main cap body.

9. The cap of a dispensing bottle according to claim 7, wherein said bottle cap lid includes a cutout portion for viewing the locked icon in the locked position of said locking ring body on said main cap body and the unlocked position of said locking ring body on said main cap body.

10. The cap of a dispensing bottle according to claim 6, wherein said locking ring body has a plurality of ridges surrounding an outer surface.

* * * * *